US006299555B1

(12) United States Patent
Zhao

(10) Patent No.: US 6,299,555 B1
(45) Date of Patent: Oct. 9, 2001

(54) BASKETBALL GOAL SOUNDING APPARATUS

(76) Inventor: Pengfei Zhao, No. 103, Building 21, Jinying Huayuan, Qinghexilu, Fuyang City, Anhui 236000 (CN)

( * ) Notice: Subject to any disclaimer, the term of this patent is extended or adjusted under 35 U.S.C. 154(b) by 0 days.

(21) Appl. No.: 09/427,641

(22) Filed: Oct. 27, 1999

(30) Foreign Application Priority Data

May 10, 1999 (CN) ..... 99210657

(51) Int. Cl.[7] ..... A63B 63/08
(52) U.S. Cl. ..... 473/479; 473/480
(58) Field of Search ..... 273/374, 378, 273/381, 382, 389; 473/472, 479, 480

(56) References Cited

U.S. PATENT DOCUMENTS

| | | | |
|---|---|---|---|
| 1,980,652 | * | 11/1934 | Wiezel et al. . |
| 2,061,152 | * | 11/1936 | Guthrie . |
| 2,413,952 | * | 7/1947 | Chervenka . |
| 4,858,920 | | 8/1989 | Best . |
| 5,064,195 | | 11/1991 | McMahan et al. . |
| 5,163,680 | | 11/1992 | Amron . |
| 5,294,913 | | 3/1994 | Mower et al. . |
| 5,300,920 | | 4/1994 | Caselli et al. . |
| 5,358,237 | | 10/1994 | Yu . |
| 5,418,517 | | 5/1995 | Matherne et al. . |
| 5,776,018 | * | 7/1998 | Simpson et al. . |
| 5,813,928 | * | 9/1998 | Hsieh . |

FOREIGN PATENT DOCUMENTS

| | | |
|---|---|---|
| 2271137Y | 12/1997 | (CN) . |
| 8-332256 | 12/1996 | (JP) . |

* cited by examiner

*Primary Examiner*—William M. Pierce
(74) *Attorney, Agent, or Firm*—Ladas & Parry

(57) ABSTRACT

A basketball goal sounding apparatus, comprises an elastic cord, a trigger, conducting wires, a switch of power supply and a audio device properly connected to each other. The trigger comprises a hollow insulating tube, a metal spring placed in the hollow insulating tube and two metal plates with conductive contact fixed to the ends of the metal spring respectively. Each end of the elastic cord is extended to the respective end of hollow insulating tube and fixed to the respective plate. One end of the conducting wires is fixed to the inner wall of the hollow insulating tube, the other end of the wires is connected to the switch of power supply and the audio device. The present invention is simple in structure and easy to be implemented, and is helpful for the judgement of whether a shot is made, and for increasing the friendly atmosphere of the game.

7 Claims, 1 Drawing Sheet

BASKETBALL GOAL SOUNDING APPARATUS

FIELD OF THE INVENTION

The present invention relates to a sports apparatus, and more particularly, to a basketball goal sounding apparatus.

Basketball is a grueling sport, favored and participated in by a great number of people. Basketball games, especially whether a shot is made or not, attract the attention of both the amateurs and fans. In particular, during important match, the athletes are deeply concerned about whether they hit the goal and whether the referee judges correctly. The spectators on the bleachers far away from the court are also eager to know the result of the ball tossed toward the goal.

BACKGROUND OF THE INVENTION

The object of the present invention is to provide a basketball goal sounding apparatus for the correct judgement of the goal, for avoiding wrong judgement due to human factors, for inspiring the athletes to hit the goal, and for increasing the friendly atmosphere of a game.

The object of the present invention is achieved by a basketball goal sounding apparatus, comprises an elastic cord placed in the lower portion of the net, a trigger, conducting wires, a switch of power supply and a audio device properly connected to each other. The trigger comprises a hollow insulating tube, a metal spring placed in the hollow insulating tube and two metal plates with conductive contact fixed to the ends of the metal spring respectively. Each end of the elastic cord is extended to the respective end of hollow insulating tube and fixed to the respective plate at a respective end of the spring to form a loop. One end of the conducting wires with a conductive contact is fixed to the inner wall of the hollow insulating tube, facing the contact of the metal plate, while the other end of the wires is connected to the switch of power supply and the audio device. The procedure of its installation and operation is as follows: The elastic cord whose diameter matches that of the net is installed at a suitable lower portion of the net in a manner as inconspicuous as possible. The wires are connected to the switch of power supply and the audio device. The audio device can be placed anywhere, such as, on the score board or the bleachers as desired. The different sounds for the two parties of a game can be pre-set. When a basketball is passed through the net of the goal, the net becomes larger in diameter as the ball falls. With the diameter of the elastic cord increasing, the metal spring connected to the ends of the elastic cord is forced to be stretched by tension, until the contacts on the plates at the ends of the metal spring come into contact with the contacts on the ends of the wires. Thus, a closed circuit is formed. Then the audio device will immediately generate the sound previously set, indicating that the ball has hit the goal. After the ball falls down, the diameter of the net is decreased and the diameter of the elastic cord is also decreased. Then the spring contracts as the tensile force vanishes. As the contacts are disconnected and the circuit is broken, no sound is generated. Therefore, each time a ball hits the goal, the audio device will sound once, which is helpful for the judgement of a shot and for inspiring the athletes to make further shots. When no ball falls in, even if the net, the hoop and/or the backboard vibrates, the audio device will not make any sound.

The present invention is simple in structure and easy to be implemented, and is helpful for the judgement of whether a shot is made, and for increasing the friendly atmosphere of the game.

BRIEF DESCRIPTION OF THE DRAWINGS

The present invention will be described in closer detail with reference to the attached drawing, in which.

DETAILED DESCRIPTION

Figure 1:
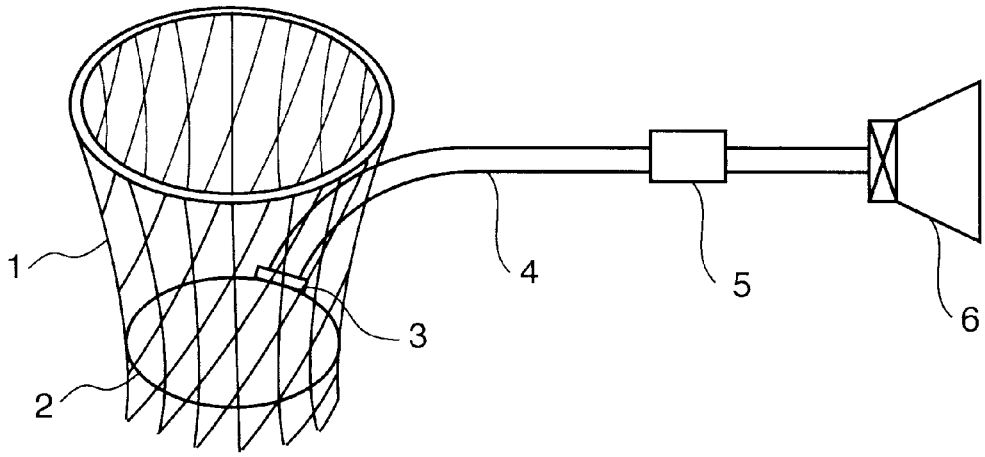
FIG. 1 is a schematic drawing of the structure of the present invention.
Figure 2:
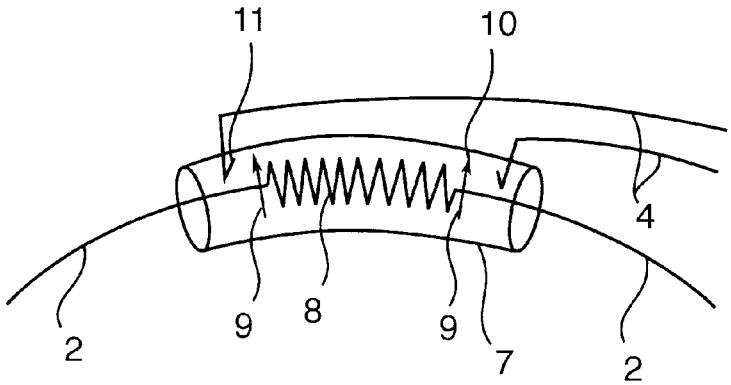
FIG. 2 is a schematic drawing of the structure of the trigger of the present invention.

As shown in FIGS. 1 and 2, a basketball goal sounding apparatus comprises an elastic cord 2 placed in the lower portion of the net 1, a trigger 3, conducting wires 4, a switch of power supply 5 and a audio device 6 properly connected to each other. The trigger 3 comprises a hollow insulating tube 7, a metal spring 8 placed in the hollow insulating tube 7 and two metal plates 9 with conductive contact 10 fixed to the ends of the metal spring 8 respectively. Each end of the elastic cord 2 is extended to the respective end of hollow insulating tube 7 and fixed to the respective plate 9 at a respective end of the spring to form a loop. One end of the conducting wires 4 with a conductive contact 11 is fixed to the inner wall of the hollow insulating tube 7, facing the contact 10 of the metal plate 9, while the other end of the wires 4 is connected to the switch of power supply 5 and the audio device 6.

What is claimed is:

1. A basketball goal sounding apparatus, comprising an elastic cord (2) placed in the lower portion of a net (1);

a trigger (3);

conducting wires (4);

a switch of power supply (5); and an audio device (6), wherein the trigger (3) comprises a hollow insulating tube (7);

a metal spring (8) placed in the hollow insulating tube (7); and two metal plates (9) with associated conductive contacts (10) fixed to the ends of the metal spring respectively (8);

each end of the elastic cord (2) is extended to a respective end of the hollow insulating tube (7) and fixed to a respective plate (9) at a respective end of the spring to form a loop;

one end of the wires (4) with a conductive contact (11) is fixed to an inner wall of the hollow insulating tube (7), facing the contact (10) of the metal plate (9), while the other end of the wires (4) is connected to the switch of power supply (5) and the audio device (6), wherein the conductive ends of the wires will contact the metal plates if and only if the spring is stretched as a basketball falls through the net.

2. A goal sounding apparatus, comprising a cord;

a metal spring with one metal plate at each end, each metal plate connecting to an end of the cord so that the cord, the spring, and the metal plates form a loop;

a hollow insulating tube placed around the spring and the metal plates;

an audio device connected by conducting wires, wherein two opening ends of the wires are fixed to an inner wall of the hollow insulating tube;

the opening ends of the wires contacting the metal plates to form a closed circuit if and only if the spring is stretched.

3. A goal sounding apparatus in claim 2, wherein the cord is placed outside a net.

4. A goal sounding apparatus in claim 2, wherein the cord is placed outside a basketball net.

5. A goal sounding apparatus in claim 2, wherein the cord is placed in lower portion of a net.

6. A goal sounding apparatus in claim 2, wherein a switch is connected to the audio device.

7. A goal sounding apparatus in claim 4, wherein the opening ends of the wires will contact the metal plates to form a closed circuit if and only if a basketball is passed through the net.

* * * * *